US009730507B2

(12) United States Patent
Wendler

(10) Patent No.: US 9,730,507 B2
(45) Date of Patent: Aug. 15, 2017

(54) RETRACTABLE SHOULDER STRAP FOR PORTABLE OBJECTS

(71) Applicant: Eric Wendler, Mt. Airy, MD (US)

(72) Inventor: Eric Wendler, Mt. Airy, MD (US)

( * ) Notice: Subject to any disclaimer, the term of this patent is extended or adjusted under 35 U.S.C. 154(b) by 246 days.

(21) Appl. No.: 14/732,851

(22) Filed: Jun. 8, 2015

(65) Prior Publication Data

US 2016/0353863 A1 Dec. 8, 2016

(51) Int. Cl.

*A45F 3/02* (2006.01)
*A45F 3/12* (2006.01)
*A45F 3/14* (2006.01)

(52) U.S. Cl.

CPC ..... *A45F 3/02* (2013.01); *A45F 3/12* (2013.01); *A45F 3/14* (2013.01)

(58) Field of Classification Search

CPC ..... A45C 3/02; A45C 13/30; A45C 13/28; A45C 13/26; A45F 3/02; A45F 3/12; A45F 2003/142; A45F 5/10; A45F 3/14; A45F 5/004; A45F 3/047; A45F 2005/006; B65H 75/4418; E06B 3/481

USPC ..... 224/254, 162, 264, 258, 643, 257, 600, 224/605, 607, 610, 616, 617; 242/389, 242/379.2, 384.7, 400, 378.1–378.4; 16/405, 114.1; 150/108

See application file for complete search history.

(56) References Cited

U.S. PATENT DOCUMENTS 2,009,192 A 7/1935 Freysinger
2,769,475 A 11/1956 Fisher
3,198,300 A 8/1965 Tuttle
3,259,285 A * 7/1966 Bush ..... A45C 13/26 224/578
5,027,874 A 7/1991 Gazzola
(Continued)

FOREIGN PATENT DOCUMENTS

FR 2608388 A1 6/1988
FR 2721484 A1 12/1995

OTHER PUBLICATIONS http://www.rakuten.com/prod/solo-leather-laptop-case-with-retractable-shoulder-strap/; Feb. 2013.

(Continued)

*Primary Examiner* — Nathan J Newhouse
*Assistant Examiner* — Matthew Theis
(74) *Attorney, Agent, or Firm* — Womble Carlyle Sandridge & Rice LLP

(57) ABSTRACT

A retractable shoulder strap for portable objects, such as bags, purses, briefcases or carry-on luggage, comprises a shoulder pad, an elongated strip of pliant material, a plurality of holes positioned at substantially uniform intervals along the length of the elongated strip, and retractors located inside the shoulder pad. Extendible guide wires passing through the plurality of holes connect the ends of the elongated strip to the retractors, which are spring-biased to automatically retract the guide wires and stow the elongated strip inside internal storage spaces in the shoulder pad, thereby eliminating slack in the strap when no tension is applied to the ends of the elongated strip. When tension is applied to the ends of the elongated strip, the portions of the elongated strip stowed in the internal storage spaces of the shoulder pad are automatically extracted, thereby increasing the length of the strap to facilitate normal over-the-shoulder use.

21 Claims, 15 Drawing Sheets

(56) References Cited

U.S. PATENT DOCUMENTS

| | | | | |
|---|---|---|---|---|
| 5,294,029 | A | 3/1994 | Shimura et al. | |
| 5,881,932 | A | 3/1999 | Wadden | |
| 5,897,039 | A | 4/1999 | Swenke | |
| 6,053,381 | A | 4/2000 | Fahl et al. | |
| 6,276,305 | B1 * | 8/2001 | Pages | A01K 27/006 119/792 |
| 7,059,504 | B2 | 6/2006 | Suggs | |
| RE39,853 | E | 9/2007 | Fier | |
| 8,015,669 | B2 | 9/2011 | Huang et al. | |
| 8,123,092 | B2 | 2/2012 | Krulik et al. | |
| 2006/0186163 | A1 | 8/2006 | Suggs et al. | |
| 2009/0014485 | A1 | 1/2009 | Yeung | |
| 2009/0174203 | A1 * | 7/2009 | Kim | A45F 3/14 294/156 |
| 2009/0255092 | A1 * | 10/2009 | Huang | A45F 5/10 16/405 |

OTHER PUBLICATIONS http://solo.net/briefcases/solo-smart-straptm-laptop-portfolio-1/; Aug. 2015.

* cited by examiner

RETRACTABLE SHOULDER STRAP FOR PORTABLE OBJECTS

CROSS-REFERENCE TO RELATED APPLICATIONS

Not Applicable.

FIELD OF ART

The present invention relates generally to shoulder straps for portable carrying devices, such as purses, handbags, briefcases, satchels, suitcases, duffle bags, carry-on luggage, computer bags, athletic bags and equipment cases. More particularly, the invention relates to shoulder straps that automatically increase or decrease their overall lengths in accordance with the amount of weight or tension supported by or applied to the distal ends of the shoulder strap.

BACKGROUND

Personal carrying devices, such purses, handbags, briefcases, satchels, suitcases, duffle bags, carry-on luggage, computer bags, athletic bags and equipment cases (hereafter referred to collectively as "bags"), often include a shoulder strap to facilitate carrying the bag by hanging the strap over the user's shoulder so that the bag hangs in the general vicinity of the user's hand. Generally speaking, shoulder straps for bags typically comprise a flexible strip of pliant material, such as nylon or leather, which is attached to opposite ends or the sides of the bag.

Unfortunately, when the user removes the shoulder strap from his or her shoulder, and carries the bag in his or her hand, the shoulder strap tends to fall downward and dangle beneath the bag while the bag is being carried, thereby exposing the user and others to danger and potential injuries resulting from tripping over the dangling strap, or accidentally allowing the dangling strap to get caught or snagged on a stationary object (or, even worse, a moving object) in the user's immediate vicinity. If the bag is placed on the ground, the floor or any other surface, the shoulder strap usually falls to the ground, the floor or other surface, where it will likely expose the user and others to danger and potential injuries resulting from tripping over the strap. Also, the strap will be exposed to increased levels of dirt, dust, soil, debris and liquid that, over time, causes the shoulder strap to take on a soiled, damaged, unattractive and unprofessional appearance. Also, when the bag is placed on top of rolling luggage, the dangling strap often falls down over the edge of the rolling luggage while the bag and luggage are moving, thereby creating another potentially serious risk of snagging, tripping and personal injury.

In addition, a loose or dangling shoulder strap that hangs beneath the bag when the bag is carried or lifted by its body or handle can be a substantial inconvenience because (1) the dangling shoulder strap tends to get caught between the bag and the ground when the bag is put down, thereby making the standing position of the bag less stable, (2) the dangling strap hangs down from overhead storage bins in airplanes and trains, causing safety concerns, (3) the dangling strap frequently must be removed to pass through airport security and scanning equipment, (4) it is much harder to use one hand to pick up the bag and move the shoulder strap onto the shoulder when the shoulder strap is wedged between the bag and ground, and (5) the dangling shoulder strap tends to lie in the aisles of airplanes and trains when the bag is stored underneath or beside a seat, creating a tripping hazard.

Although a variety of different devices and mechanisms have been introduced for adjusting, retracting and securing loose and dangling shoulder straps for bags, the conventional devices and mechanisms are often unreliable, or otherwise too complicated, expensive or unattractive for a majority of users. Moreover, most of the conventional devices and mechanisms for adjusting, retracting and securing loose and dangling shoulder straps add too much cost and too much time to the manufacturing process, as well as a substantial amount of weight to the combined weight of the bag and the shoulder strap.

Accordingly, there is considerable need in the handbag, carry-on, briefcase, athletic bag and luggage industries for a convenient, reliable and inexpensive shoulder strap for bags, wherein the shoulder strap is configured to automatically retract when tension is removed from the strap. There is a further need for an automatically retracting shoulder strap that is both compact and lightweight, and that will not hang below the bottom of the bag or drag on the ground when the shoulder strap is not in use. There is also a need for a retractable shoulder strap that maintains a clean, attractive and professional appearance when the shoulder strap is not being used to carry the bag to which it is attached. And finally, there is also a pressing need for a personal carrying device having a shoulder strap characterized by all of these desirable features.

SUMMARY OF THE INVENTION

As will be described in more detail below, aspects and embodiments of the present invention address the above-described needs, as well as other deficiencies and problems associated with known shoulder straps, by providing a retractable shoulder strap for a portable object, such as a purse, handbag, briefcase, satchel, suitcase, duffle bag, carry-on luggage piece, computer bag, athletic bag or equipment case. In general, the retractable shoulder strap of the present invention comprises a shoulder pad, an elongated strip of pliant material, a plurality of holes positioned at intervals along the length of the elongated strip of pliant material, and a pair of retractors located inside the shoulder pad, the pair of retractors having a pair of retractable spindles configured to wind and unwind a pair of extendible guide wires connected to the distal ends of the shoulder strap and passing through the plurality of holes in the elongated strip of pliant material.

More specifically, the shoulder pad comprises a base wall and a cover, which are joined together to define (1) a pair of openings at opposite ends of the shoulder pad, (2) a pair of internal storage spaces adjacent to the pair of openings, and (3) a retractor housing area bounded by the base wall, the cover and the pair of internal storage spaces. The elongated strip of pliant material, which passes through the pair of openings in the shoulder pad, comprises a forward section, a middle section and a rearward section. The middle section is fixedly attached to the base wall. A portion of the forward section extends through one of the openings in the pair of openings so that the distal end of the forward section is located on the outside of one of the internal storage spaces in the shoulder pad. A portion of the rearward section extends through the other opening in the pair of openings so that the distal end of the rearward section is located on the outside of the other internal storage space. Preferably, a pair of fasteners are attached to the distal ends of the forward and rearward sections of the elongated strip of pliant material, the pair of fasteners comprising, for example, hooks, clasps or buckles, configured to permit the user to releasably fasten the forward and rearward sections of the elongated strip to the portable object (i.e., to the top, sides or ends of the purse, handbag, briefcase, satchel, suitcase, duffle bag, carry-on luggage piece, computer bag, athletic bag or equipment case).

The pair of retractors are located inside the retractor housing area of the shoulder pad. Ideally, the pair of retractors are fixedly connected to the retractor housing area. Each retractor in the pair of retractors has a rotatable spindle and an extendible guide wire configured to wind around the rotatable spindle. The distal ends of each one of the extendible guide wires is attached to the distal ends of the forward and rearward sections, respectively, of the elongated strip of pliant material so that the pair of extendible guide wires pass through the plurality of holes in the forward and rearward sections of the elongated strip of pliant material.

Notably, the pair of rotatable spindles in the pair of retractors are biased so that, when no tension is applied to the distal ends of the forward and rearward sections of the elongated strip of pliant material, the pair of rotatable spindles will automatically rotate in a direction that winds the pair of extendible guide wires around the pair of rotatable spindles, thereby causing the forward and rearward sections of the elongated strip of pliant material to be retracted into and stored inside the pair of internal storage spaces of the shoulder pad. The rotatable spindles may be biased toward rotating in the direction of winding up the pair of extendible guide wires by any suitable biasing mechanism, including without limitation a coiled spring.

When a sufficient amount of tension is applied to the distal ends of the forward and rearward sections of the elongated strip of pliant material to overcome the bias on the pair of rotatable spindles, the pair of rotatable spindles will rotate in the opposite direction to unwind the pair of extendible guide wires from the pair of rotatable spindles. The combination of the tension applied to the distal ends of the forward and rearward sections of the elongated strip and the unwinding and releasing of the pair extendible guide wires permits the forward and rearward sections of the elongated strip of pliant material stored inside the pair of internal storage spaces of the shoulder pad to be pulled out of the pair internal storage spaces through the pair of openings in the shoulder pad. When the forward and rearward sections of the elongated strip are extended in this manner, the user can easily place the shoulder pad on his or her shoulder and use the shoulder strap in the conventional manner.

Ideally, the portions of the forward and rearward sections of the elongated strip of pliant material that lie outside the pair of openings in the shoulder pad when the shoulder strap is extended are configured to automatically bend and repeatedly fold back upon themselves, in accordion fashion, when the distal ends of the forward and rearward sections are pulled toward the shoulder pad by the pair of extendible guide wires. As a result of the continued pulling by the pair of extendible guide wires, these folded portions of the forward and rearward sections are retracted and stored inside the pair of internal storage spaces in the shoulder pad, thereby hiding the folded portions of the forward and rearward sections of the elongated strip from view while the shoulder strap is in the retracted position. Conversely, when a sufficient amount of tension is applied to the distal ends of the forward and rearward sections of the elongated strip to overcome the bias on the pair of rotatable spindles, the folded portions of the forward and rearward sections of the elongated strip of pliant material that was previously stored inside the pair of internal storage spaces, respectively, automatically unfold as the forward and rearward sections of the elongated strip are being pulled through the pair of openings and extracted from the internal storage spaces.

In another aspect of the present invention, there is provided a personal carrying device, comprising a receptacle (such as a purse, briefcase, a carry-on or a computer case), a shoulder pad, an elongated strip of pliant material, a pair of retractors, and a pair of fasteners for releasably attaching the elongated strip to the receptacle. The shoulder pad comprises a base wall and a cover joined together to define (1) a pair of openings at opposite ends of the shoulder pad, (2) a pair of internal storage spaces adjacent to the pair of openings, and (3) a retractor housing area bounded by the base wall, the cover and the pair of internal storage spaces. The elongated strip of pliant material has a forward section, a middle section and a rearward section. The middle section is fixedly attached to the base wall. A portion of the forward section is stored inside one of the internal storage spaces. And a portion of the rearward section is stored inside the other internal storage space.

The pair of retractors are located inside the retractor housing area of the shoulder pad. Each retractor has an extendible guide wire and a rotatable spindle that is biased to automatically wind the extendible guide wire around the rotatable spindle. The distal ends of the extendible guide wires are attached, respectively, to the distal ends of the forward and rearward sections of the elongated strip of pliant material. When the shoulder pad, the forward section and the rearward section of the elongated strip are allowed to support the weight of the receptacle, the weight of the receptacle produces a sufficient amount of tension at the distal ends of the forward section and the rearward section of the elongated strip of pliant material to overcome the bias on the pair of rotatable spindles. This causes the pair of rotatable spindles to rotate in a direction that unwinds the pair of extendible guide wires from around the pair of rotatable spindles. The unwinding of the extendible guide wires and the tension produced by the weight of the receptacle combine to pull the portions of the forward section and the rearward section of the elongated strip stored in the pair of internal storage spaces through the openings of the shoulder pad, thereby extracting the forward and rearward sections of the elongated strip from the internal storage spaces.

Conversely, when the tension (and/or the weight of the receptacle) is removed from the components of the shoulder strap, the biasing force in the retractors will cause the pair of rotatable spindles to rotate in the opposite direction to wind the pair of extendible guide wires around the pair of rotatable spindles, respectively, thereby retracting the pair of extendible guide wires into the pair of retractors. When this happens, the pair of extendible guide wires will pull the forward and rearward sections of the elongated strip of pliant material back into the pair of internal storage spaces in the shoulder pad. Consequently, substantially all of the slack is removed from the shoulder strap, thereby preventing the shoulder strap from hanging loosely below the bottom of the receptacle, where it could potentially expose the user or others to unnecessary risks of snagging, entanglement and/or tripping.

BRIEF DESCRIPTION OF THE DRAWINGS

The present invention and various aspects, features and advantages thereof are explained in more detail below with reference to exemplary and therefore non-limiting embodiments and with the aid of the drawings, which constitute a part of this specification and include depictions of the exemplary embodiments. In these drawings.

DETAILED DESCRIPTION OF EXEMPLARY EMBODIMENTS

It is anticipated that embodiments of the present invention may be utilized in a variety of different industries, including without limitation, the fashion, business, sports, military and travel industries, or any other industry involving portable carriers and personal carrying devices.

Figure 1:
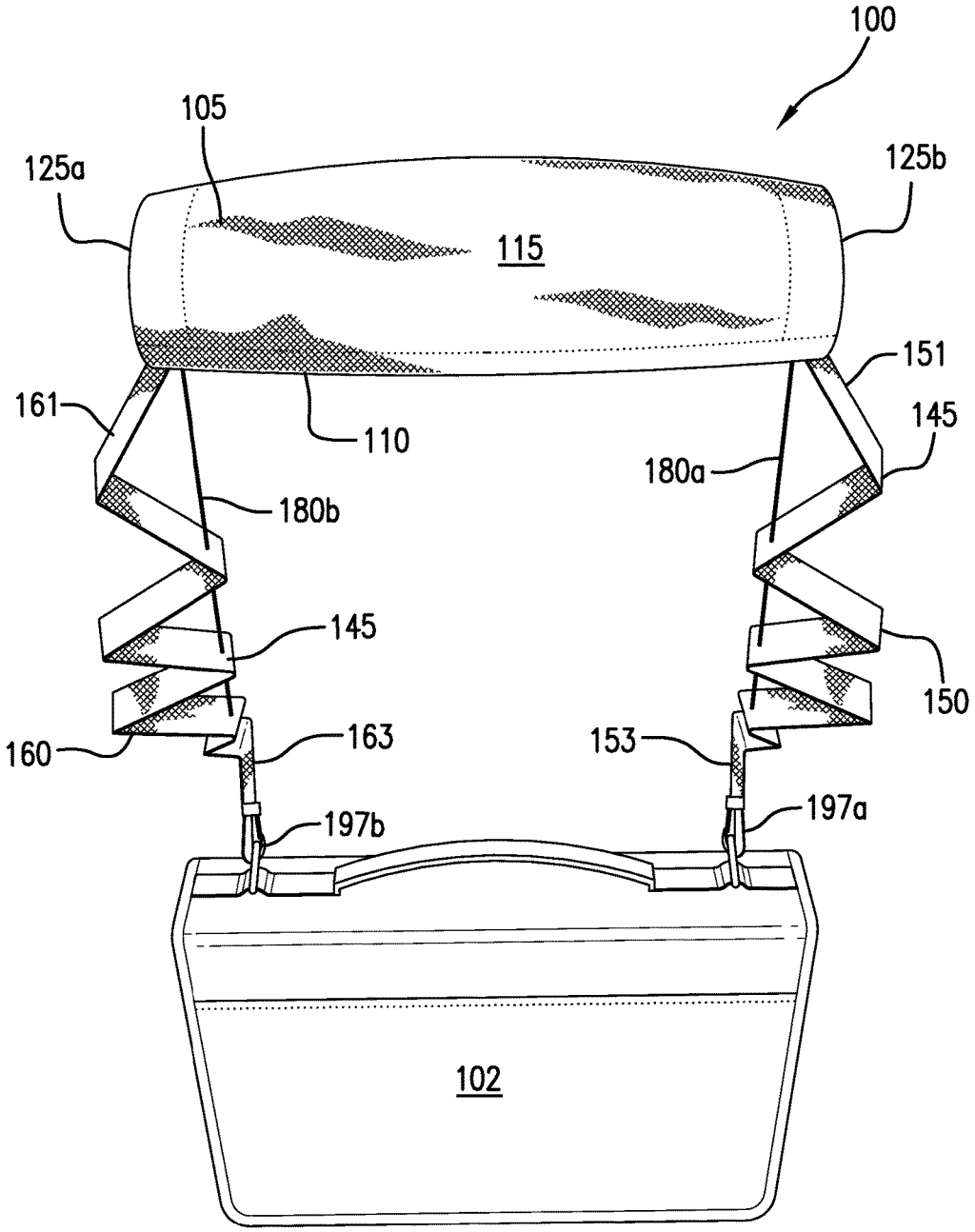
FIG. 1 shows a retractable shoulder strap, constructed in accordance with an exemplary embodiment of the present invention, in which the forward and rearward sections of the strap are mostly extended.

FIG. 1 shows a retractable shoulder strap 100, constructed in accordance with an exemplary embodiment of the present invention, attached to a portable briefcase 102. As shown in FIG. 1, the shoulder strap 100 generally comprises a shoulder pad 105 having a base wall 110 and a cover 115. The shoulder strap 100 also comprises an elongated strip 145 of pliant material (e.g., nylon or leather) that passes through the interior sections of the shoulder pad 105 via a pair of openings 125*a* and 125*b* located at opposite ends of the shoulder pad 105. The interior sections of the shoulder pad 105 are not visible in FIG. 1 because they are concealed by the cover 115 and the base wall 110 of the shoulder pad 105. However, the interior sections of the shoulder pad 105 are shown in the cut-away view depicted in FIG. 7, which is discussed in more detail below.

The elongated strip 145 of pliant material comprises a forward section 150, a middle section (not shown in FIG. 1) and a rearward section 160. As illustrated by FIG. 1, the proximal end 151 of the forward section 150 of the elongated strip 145 passes into the opening 125*a* of the shoulder pad 105. However, a substantial portion of the forward section 150 remains on the outside of the opening 125*a* of the shoulder pad 105. Likewise, the proximal end 161 of the rearward section 160 of the elongated strip 145 passes into the opening 125*b* of the shoulder pad 105, leaving a substantial portion of the rearward section 160 on the outside of the opening 125*b* of the shoulder pad 105.

As further shown in FIG. 1, a pair of fasteners 197*a* and 197*b* are connected, respectively, to the distal ends 153 and 163 of the forward section 150 and rearward section 160 of the elongated strip 145. These fasteners 197*a* and 197*b* are used to releasably attach the portable briefcase 102 to the distal ends 153 and 163 of the forward section 150 and rearward section 160. In addition, a pair of extendible guide wires 180*a* and 180*b* are also connected to the distal ends 153 and 163, respectively, of the forward section 150 and rearward section 160 of the elongated strip 145. The extendible guide wires 180*a* and 180*b* pass through a plurality of holes (best shown in FIGS. 5 and 6) located at substantially uniform intervals along the lengths of the forward section 150 and rearward section 160 of the elongated strip 145. Although not shown in FIG. 1, the other ends of the extendible guide wires 180*a* and 180*b* are connected to a pair of rotatable spindles located inside a pair of retractors, respectively, which are in turn located in an interior section of the shoulder pad 105.

The pair of rotatable spindles inside the pair of retractors are biased to rotate in a direction that causes the extendible guide wires 180*a* and 180*b* to be pulled into the shoulder pad 105 through the pair of openings 125*a* and 125*b*. Therefore, as the distance between the shoulder pad 105 and the portable briefcase 102 decreases, the biasing effect on the rotatable spindles cause the extendible guide wires 180*a* and 180*b* to wind around the rotatable spindles and withdraw into the shoulder pad 105 via the openings 125*a* and 125*b*. The withdrawal of the extendible guide wires 180*a* and 180*b* into the shoulder pad 105 automatically pulls the forward section 150 and the rearward section 160 through the pair of openings 125*a* and 125*b* and into the internal storage spaces 135*a* and 135*b* of the shoulder pad 105.

Figure 2:
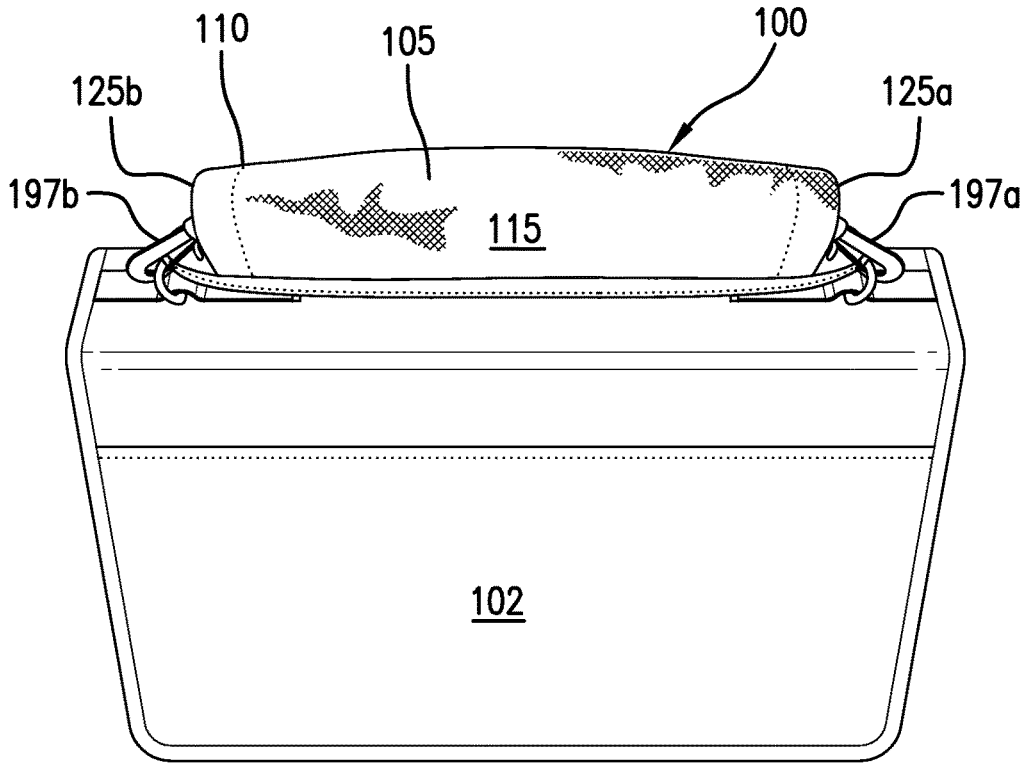
FIG. 2 shows the retractable shoulder strap of FIG. 1 with the forward and rearward sections of the shoulder strap fully retracted and concealed within the pair of openings located at opposite ends of the shoulder pad, thereby causing the base wall of the shoulder pad in the shoulder strap to abut the top of the briefcase to which the shoulder strap is releasably attached.
Figure 3:
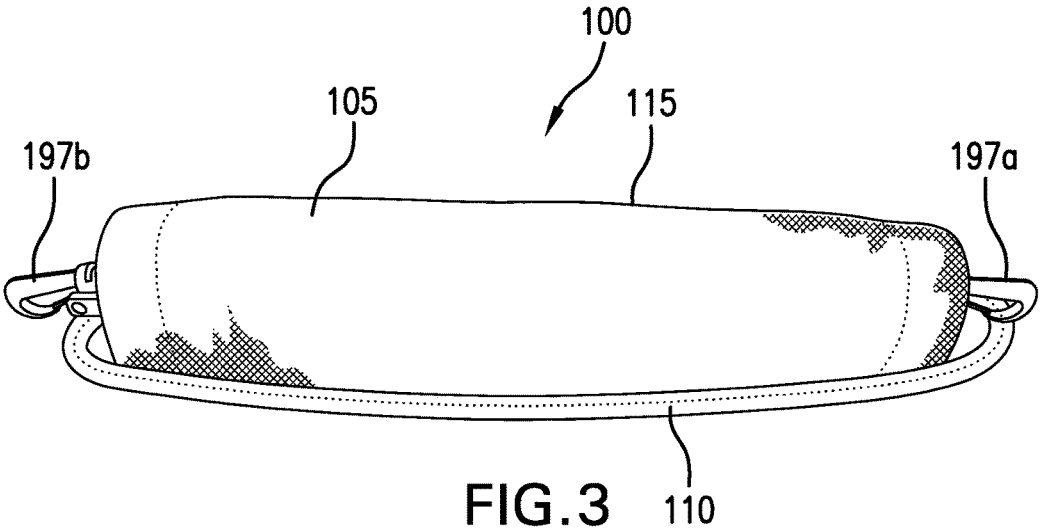
FIG. 3 shows a retractable shoulder strap, constructed according to an exemplary embodiment of the present invention, in a fully-retracted state, without any bag, purse or briefcase attached.

FIG. 2 shows the retractable shoulder strap 100 of FIG. 1 with the forward section 150 and rearward section 160 of the elongated strip 145 in their fully retracted positions. As shown in FIG. 2, the forward section 150 and the rearward section 160 are both substantially concealed inside the shoulder pad 105, and only the fasteners 197*a* and 197*b* remain visible on the outside of the pair of openings 125*a* and 125*b* of the shoulder pad 105. When the forward section 150 and the rearward section 160 are in their fully retracted positions inside the shoulder pad 105, the base wall 110 of the shoulder pad 105 remains neatly and conveniently affixed to the top of the portable briefcase 102 instead of dangling loosely toward the floor or the ground. FIG. 3 shows a retractable shoulder strap 100, constructed according to an exemplary embodiment of the present invention, in a fully-retracted state, without a bag, purse or briefcase attached.

Figure 4:
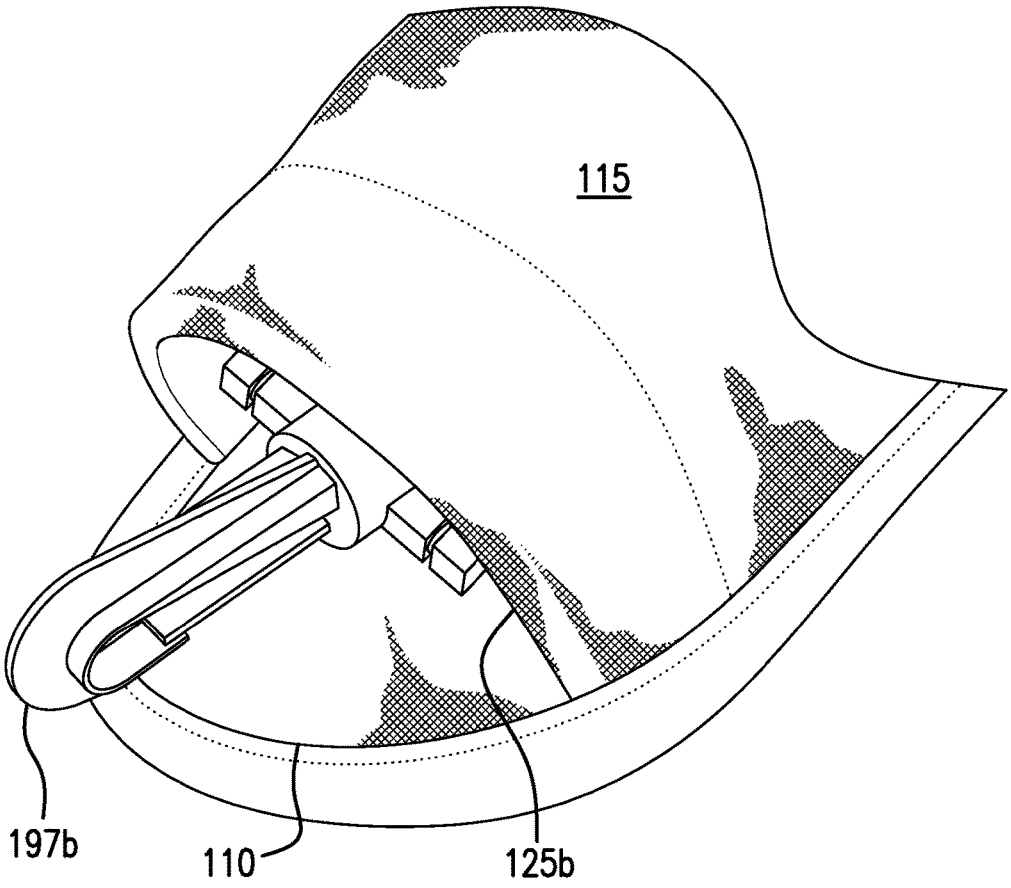
FIG. 4 shows a close-up view of one end of the shoulder pad according to one embodiment of the present invention.

FIG. 4 shows a close-up view of the fastener 197*b* and the opening 125*b* located at one end of the shoulder pad 105 according to one embodiment of the present invention. Although the fastener 197*b* in FIG. 4 is a clasp, it will be appreciated by those skilled in the art that a variety of other types of fasteners might be used without departing from the scope of present invention, including without limitation, a hook, a buckle or a snap.

Figure 5:
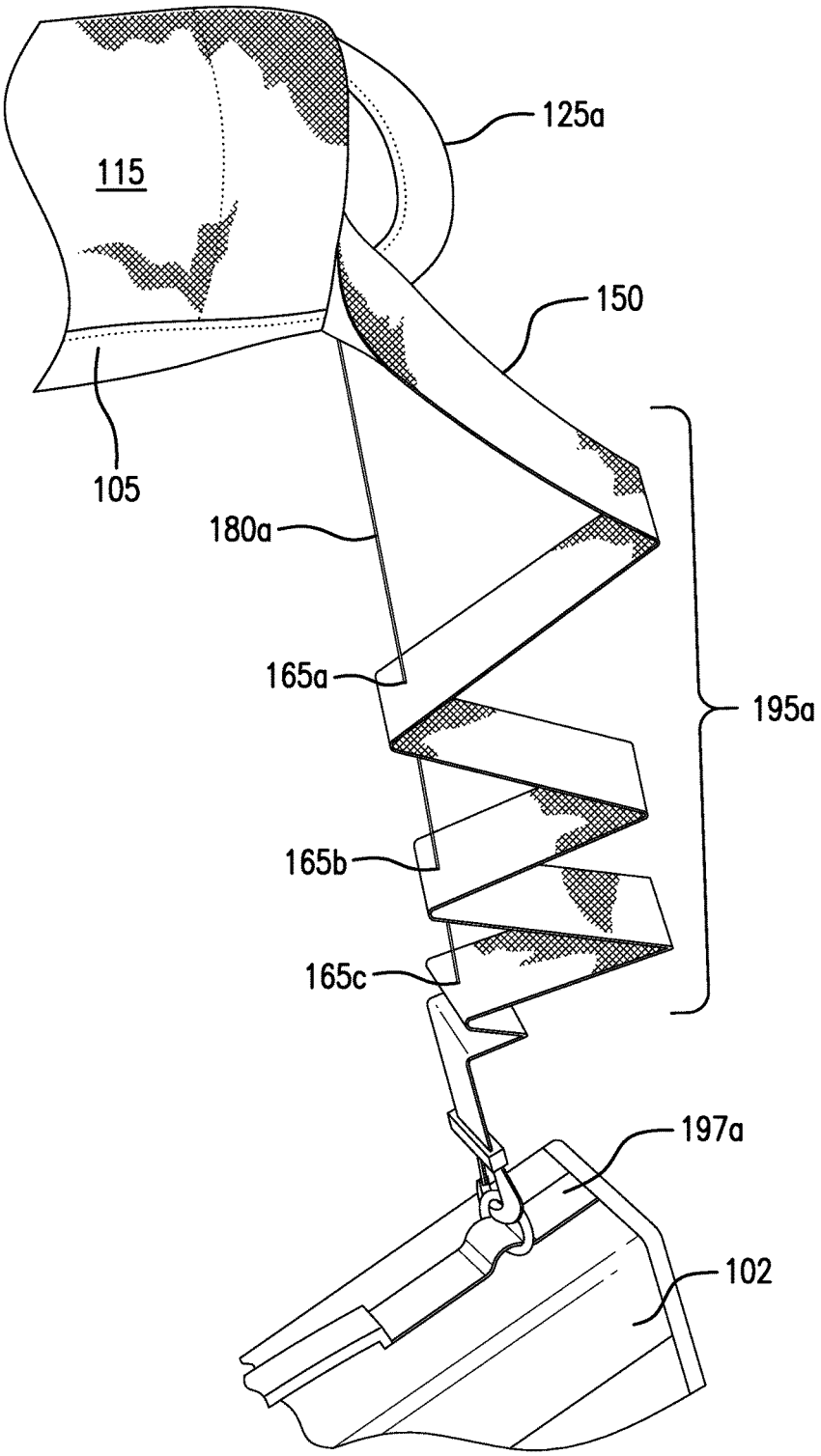
FIGS. 5 and 6 show, respectively, the forward section and the rearward section of the elongated strip of pliant material according to an embodiment of the present invention.
Figure 6:
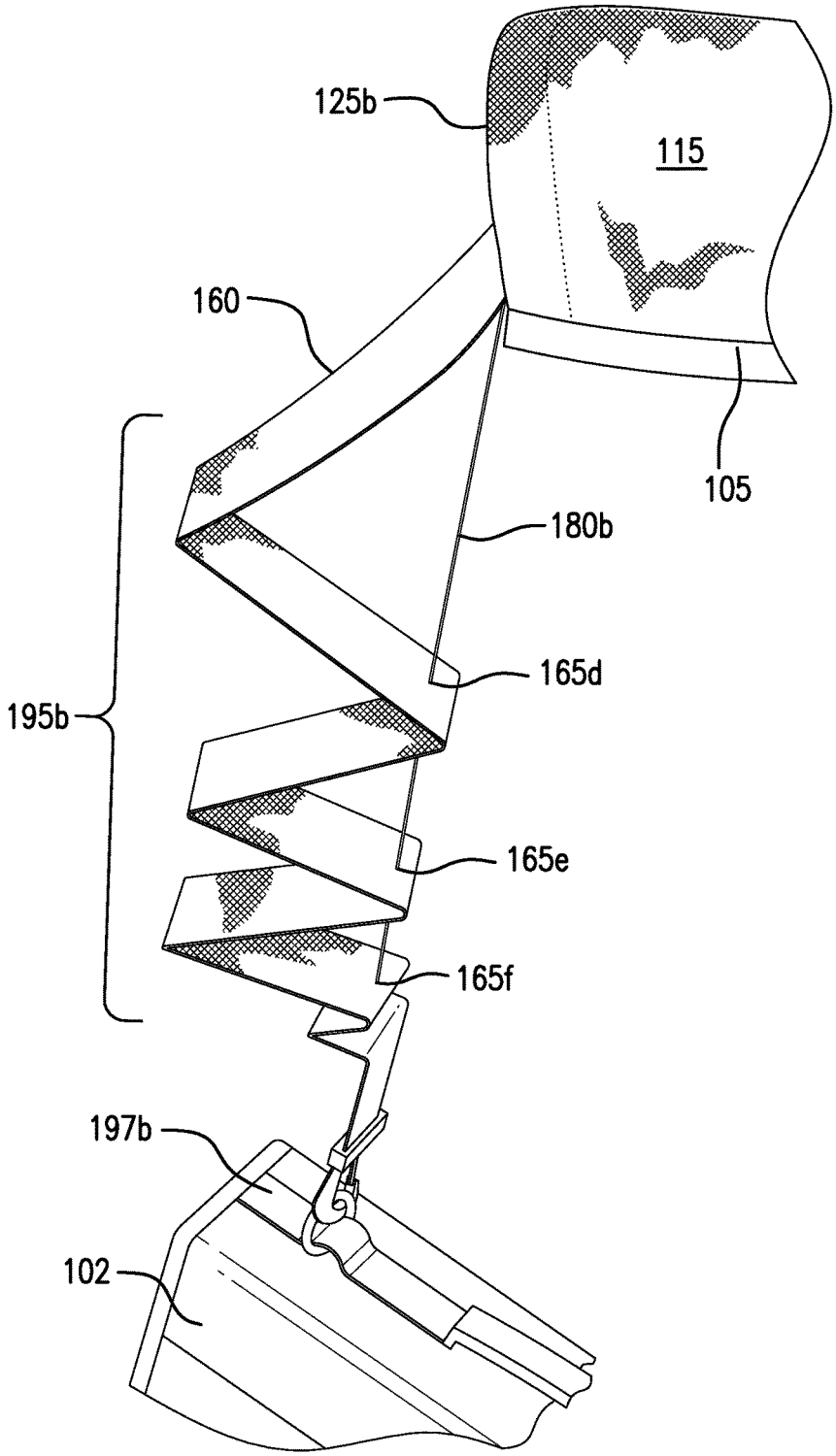

FIGS. 5 and 6 show, respectively, the forward section 150 and the rearward section 160 of the elongated strip 145 of pliant material according to the preferred embodiment of the present invention. As shown in FIG. 5, the forward section 150 of the elongated strip 145 includes multiple pairs of holes 165*a*-165*c* located at substantially uniform intervals along the center of the forward section 150. In this case, the multiple pairs of holes 165*a*-165*c* are located at substantially uniform intervals along the forward section 150. The holes in each pair of holes are separated by one of the folds in the plurality of folds 195*a* in the forward section 150. The extendible guide wire 180*a* that passes out of the opening 125*a* in the shoulder pad 105 also passes through each hole in the multiple pairs of holes 165*a*-165*c* in the forward section 150. The substantially uniform spacing of the multiple pairs of holes 165*a*-165*c* ensures that when the extendible guide wire 180*a* is retracted into the shoulder pad 105, the forward section 150 of the elongated strip 145 will be forced to repeatedly bend and fold back upon itself to form the plurality of folds 195*a* that will be pulled through the opening 125*a* and stored in the internal storage space 135*a* of the shoulder pad 100. In some embodiments, the multiple pairs of holes 165*a*-165*c* may be reinforced by grommets (not shown in the figures).

As shown in FIG. 6, the rearward section 160 of the elongated strip 145 includes multiple pairs of holes 165*d*-165*f* located at substantially uniform intervals along the center of the rearward section 160. The multiple pairs of holes 165*d*-165*f* are located at substantially uniform intervals along the rearward section 160. The holes in each pair of holes are separated by one of the folds in the plurality of folds 195*b* in the rearward section 160. The extendible guide wire 180*b* that passes out of the opening 125*b* in the shoulder pad 105 passes through the multiple pairs of holes 165*d*-165*f*. The substantially uniform spacing of the multiple pairs of holes 165*d*-165*f* ensures that when the extendible guide wire 180*b* is retracted into the shoulder pad 105, the rearward section 160 of the elongated strip 145 will also be forced to repeatedly bend and fold back upon itself to form the plurality of folds 195*b*, which will be pulled through the opening 125*b* and stored in the other internal storage space 135*b* of the shoulder pad 100.

Figure 7:
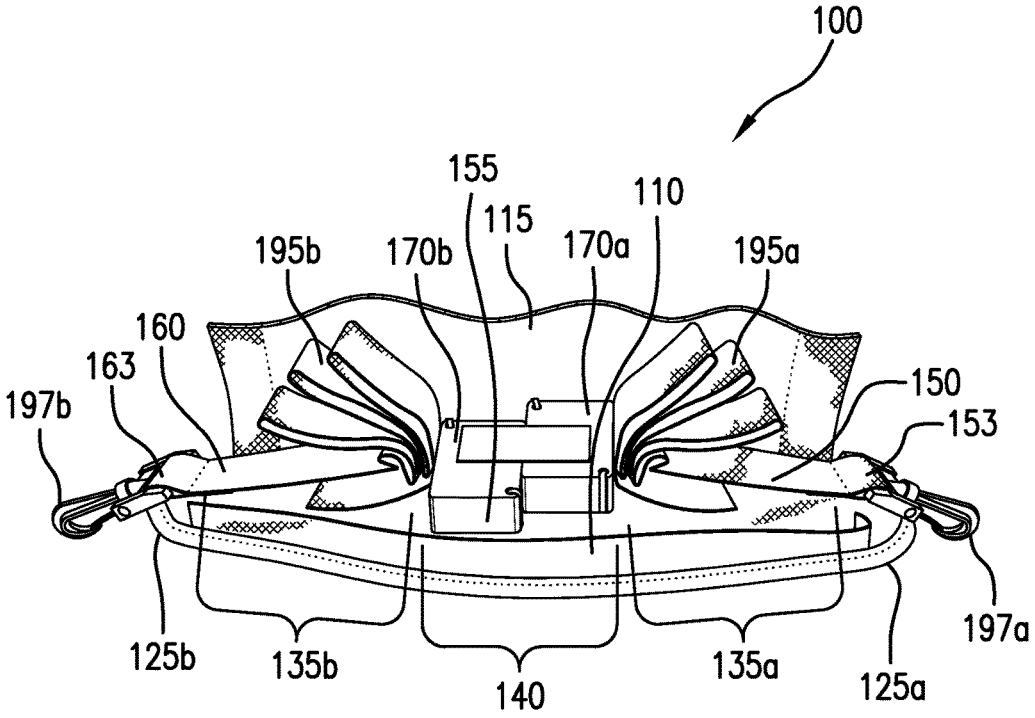
FIG. 7 shows another view of a shoulder strap constructed in accordance with an embodiment of the present invention, in which the cover has been cut away in order to better illustrate the internal features of the shoulder pad.

FIG. 7 shows another view of a shoulder strap 100 constructed in accordance with an embodiment of the present invention. In FIG. 7, however, the cover 115 has been cut away in order to better illustrate the internal features of the shoulder pad 105 of the shoulder strap 100. As shown in FIG. 7, the internal features of shoulder pad 105 include a pair of internal storage spaces 135*a* and 135*b* located just inside of the pair of openings 125*a* and 125*b*, respectively. Interposed between the internal storage spaces 135*a* and 135*b* is a retractor housing area 140 to accommodate a pair of retractors 170*a* and 170*b*. The retractors 170*a* and 170*b* may be fixedly secured by any suitable means (including without limitation, tape, thread or glue) to the base wall 110 of the shoulder pad 105, and/or the middle section 155 of the elongated strip 145 of pliant material, and/or the cover 115. The retractors 170*a* and 170*b* typically face in opposite directions so that the extendible guide wires 180*a* and 180*b* (not visible in FIG. 7) feed out from the retractors 170*a* and 170*b* in opposite directions toward the pair of openings 125*a* and 125*b* of the shoulder pad 105.

The elongated strip 145 of pliant material passes through the pair of openings 125*a* and 125*b* at opposite ends of the shoulder pad 105. Ideally, the elongated strip 145 passes underneath the retractors 170*a* and 179*b*, so that the middle section 155 of the elongated strip 145 is sandwiched between and fixedly secured to the base wall 110. In alternative embodiments, however, these components may instead be arranged so that the middle section 155 of the elongated strip 145 passes between the cover 115 and the top of the retractors 170*a* and 170*b*. In this configuration, the middle section 155 of the elongated strip 145 may be fixedly secured (by tape, thread or glue, for example) to the cover 115, the top of the retractors 170*a* and 170*b*, or both the cover 115 and the top of the retractors 170*a* and 170*b*.

The forward section 150 and the rearward section 160 of the elongated strip 145 are shown in FIG. 7 in their fully retracted positions. Preferably, the extendible guide wires 180*a* and 180*b* are arranged to pass through the plurality of holes in the forward and rearward sections 150 and 160 at substantially uniform intervals so that the action of retracting the forward and rearward sections 150 and 160 into the pair of internal storage spaces 135*a* and 135*b* results in the forward section 150 and the rearward section 160 repetitively folding back upon themselves, in accordion fashion, to create a plurality of folds 195*a* and 195*b*.

As shown in FIG. 7, a portion of the forward section 160 extends through the opening 125*a* in the shoulder pad 105 so that the distal end 153 of the forward section 150 remains on the outside of the internal storage space 135*a*, even when the forward section 150 is fully retracted. Likewise, a portion of the rearward section 160 extends through the other opening 125*b* of the shoulder pad 105 so that the distal end 163 of the rearward section 160 remains on the outside of the internal storage space 135*b*, even when the rearward section 160 is fully retracted. The fasteners 197*a* and 197*b*, which are attached to the distal ends 153 and 163 of the forward section 150 and rearward section 160, respectively, permit the user to attach the shoulder strap 100 to corresponding hooks on a personal carrying device or receptacle (not shown in FIG. 7), such as a purse, handbag, briefcase, satchel, athletic bag, duffle bag or suitcase.

Figure 8:
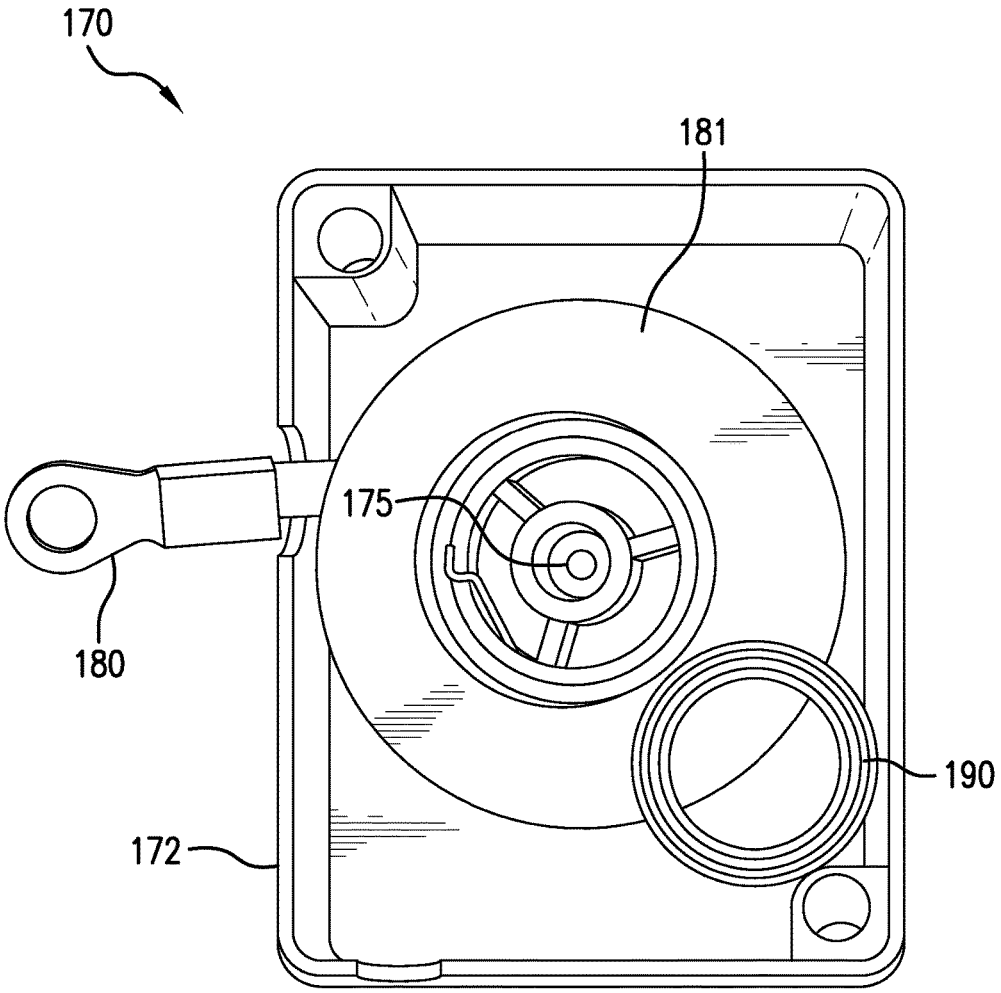
FIG. 8 shows a sectioned view of an exemplary retractor suitable for use with some embodiments of the present invention.

FIG. 8 shows a cut-away view of an exemplary retractor 170 suitable for use with some embodiments of the present invention, wherein the top wall of the outer shell 172 of the retractor 170 has been removed to better illustrate the internal components of the retractor 170. As shown in FIG. 8, the retractor 170 includes an extendible guide wire 180 that is attached to and configured to wrap around a rotatable spindle 175 (or spool) when the rotatable spindle 175 is rotated in a clockwise direction. A guide wire casing 181 is provided to receive and secure the coils of the extendible guide wire 180 as it is wrapped around the rotatable spindle 175. A coiled spring 190, which is coupled to the rotatable spindle 175, applies a constant biasing force to the rotatable spindle 175 so that the rotatable spindle 175 will always tend to rotate in the clockwise direction, thereby causing the extendible guide wire 180 to retract into the guide wire casing 181 and wrap around the rotatable spindle 175. However, the biasing force may be overcome by an external force (such as the weight of the briefcase, computer bag or other receptacle) that pulls on the distal end of the extendible guide wire 180, thereby unwinding the extendible guide wire 180 from the rotatable spindle 175 and extracting the coils of the extendible guide wire 180 from the guide wire casing 181. In alternative embodiments, such as the embodiment shown in FIGS. 13 and 14, the pair of retractors 170 may not include an outer shell 172.

In preferred embodiments, the shoulder pad 105 is constructed from pieces of nylon material that are sewn together to form the base wall 110, the cover 115, the pair of internal storage spaces 135*a* and 135*b*, the retractor housing area 140 and the pair of openings 125*a* and 125*b*. However, other materials, such as cloth, fabric, leather, plastic, vinyl or rubber, may also be used to construct the shoulder pad 105. In some embodiments, the shoulder pad 105 may be constructed from a combination of two or more of these materials. Ideally, the base wall 110 of the shoulder pad 105 also includes a pad or cushion constructed from a soft foam, rubber, silicone, or other material, to make the shoulder pad more comfortable as it sits on the user's shoulder.

The elongated strip 145 of pliant material serves as the strap component of the shoulder strap 100 of the present invention. The length, width and composition of the elongated strip 145 of pliant material of the strap can vary. In preferred embodiments, however, the elongated strip 145 is a continuous length of thin nylon approximately one inch in width and fifty inches in length. The elongated strip 145 may be fixedly secured to the shoulder pad 105 by various methods, such as by sewing the elongated strip 145 to the base wall 110 or the cover 115.

In preferred embodiments, the extendible guide wires 180*a* and 180*b* are constructed from flexible lengths of nylon. However, the extendible guide wires 180*a* and 180*b* may also be constructed from a variety of other materials, including without limitation, metal, plastic, fabric, cloth, leather, natural fiber cord, string, or any combination of two or more of these materials. The distal ends of the extendible guide wires 180*a* and 180*b* are typically sewn into the distal ends 153 and 163 of the forward and rearward sections 150 and 160 of the elongated strip 145. The purpose of the extendible guide wires 180*a* and 180*b* are to retract the forward and rearward sections 150 and 160 into the internal storage spaces 135*a* and 135*b* of shoulder pad 105. The weight of the personal carrying device is supported by the elongated strip 145.

Figure 9:
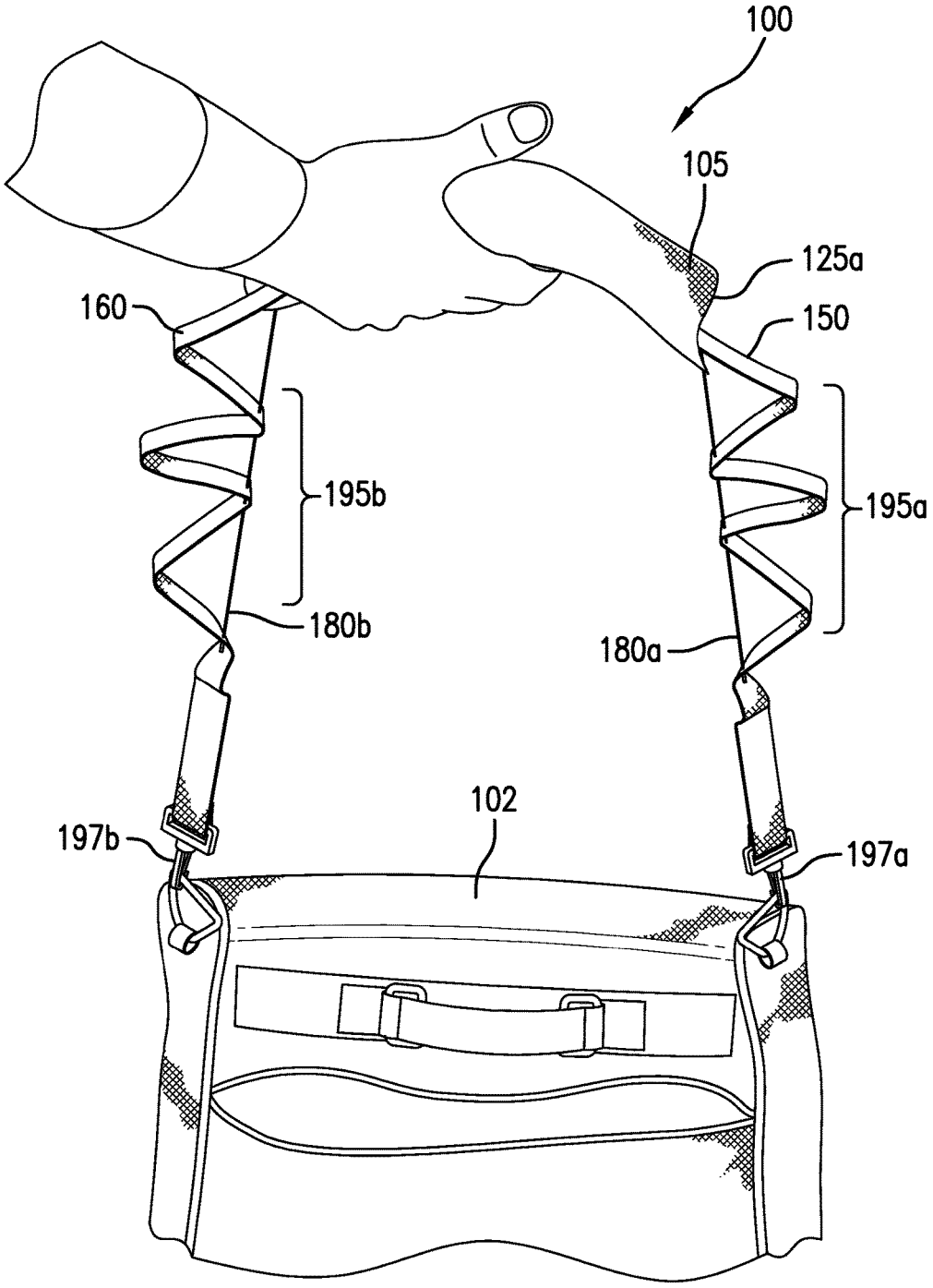
FIGS. 9 and 10 show, respectively, how a user would typically use a shoulder strap constructed in accordance with one embodiment of the present invention.
Figure 10:
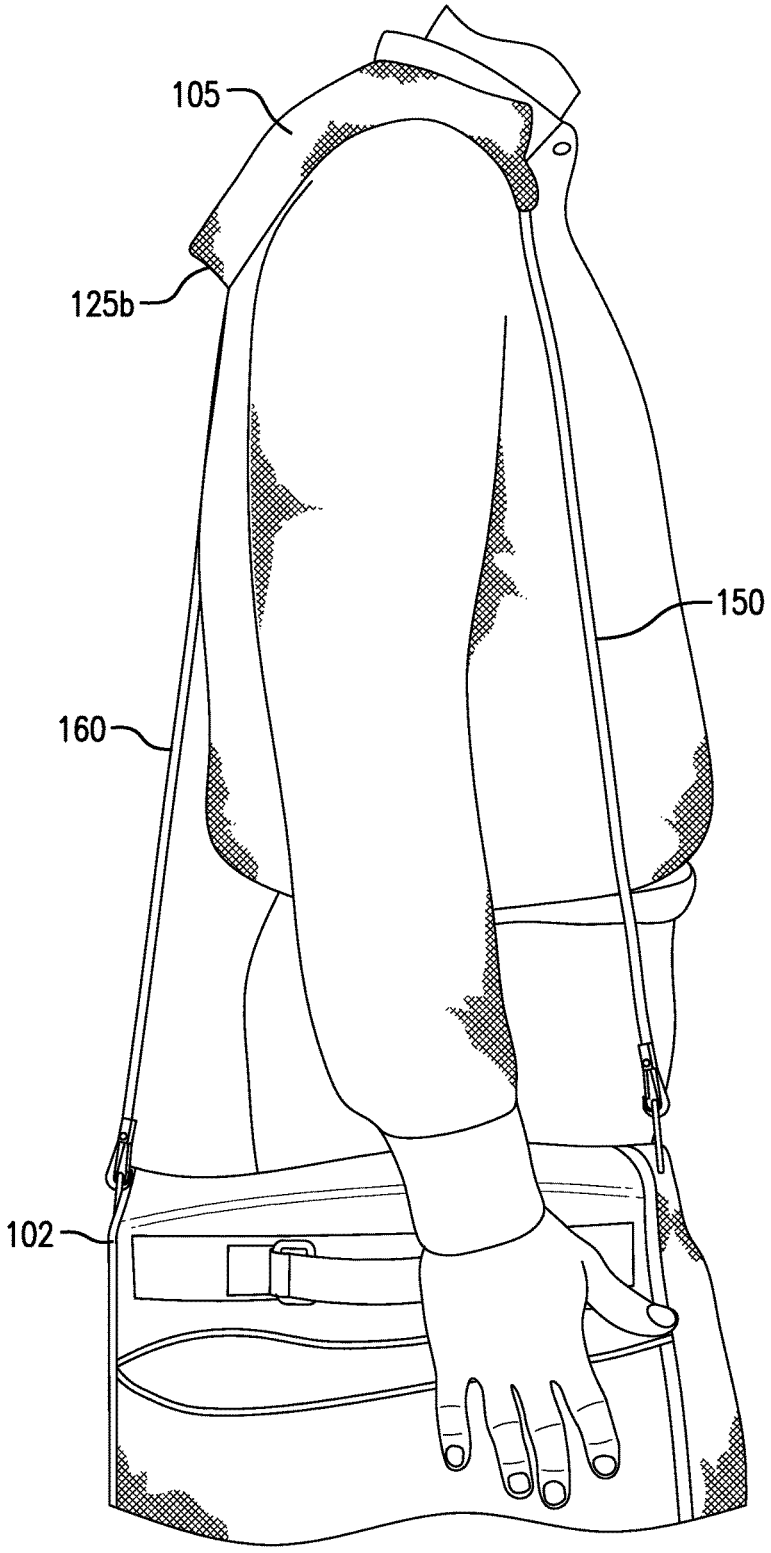

FIGS. 9 and 10 show, respectively, how a user would typically use a retractable shoulder strap 100 constructed according to one embodiment of the present invention with a briefcase 102 (or other personal carrying device). To use the embodiment of the invention shown in FIGS. 9 and 10, the user first attaches the retractable shoulder strap 100 to the briefcase 102 (or other personal carrying device) by affixing the fasteners 197*a* and 197*b* to corresponding hooks on either end of the briefcase 102. The user then grasps the center of the shoulder pad 105 and lifts upward. As the shoulder pad 105 is lifted upward, the weight of the briefcase 102 puts tension on the extendible guide wires 180*a* and 180*b*, which causes the forward and rearward sections 150 and 160 to be pulled out of the internal storage spaces 125*a* and 125*b* of the shoulder pad 105. As this happens, the previously folded portions 195*a* and 195*b* of the forward and rearward sections 150 and 160 also begin to unfold as shown in FIG. 9. The user then places the shoulder pad 105 on his or her shoulder, with the forward section 150 facing the front of the user's body and the rearward section 160 facing the rear. When fully extended, the forward and rearward sections 150 and 160 will hang substantially straight down, as shown in FIG. 10, and take on the appearance and functionality of conventional non-retractable shoulder straps.

To retract the forward and rearward sections 150 and 160 of the shoulder strap 100, the user grasps the center of the shoulder pad 105 and lifts the shoulder pad 105 off of the shoulder. Then the user places the briefcase on the floor or another surface before lowering the shoulder pad 105 toward the briefcase 102. As the distance between the shoulder pad 105 and the briefcase 102 decreases, the tension on the extendible guide wires 180*a* and 180*b* is gradually removed. This causes the retractors 170*a* and 170*b* inside the shoulder pad 105 to retract the extendible guide wires 180*a* and 180*b* into their guide wire housings 181, thereby causing the forward and rearward sections 150 and 160 to bend and fold back upon themselves so as to reproduce the folded portions 195*a* and 195*b*. As the extendible guide wires 180*a* and 180*b* continue retracting into the retractors 170*a* and 170*b*, the folded portions 195*a* and 195*b* are pulled through the openings 125*a* and 125*b* of the shoulder pad 105 and stowed in the internal storage spaces 135*a* and 135*b*. When the forward and rearward sections 150 and 160 are fully retracted, the base wall 110 of the shoulder pad 105 will rest neatly on the top surface of the briefcase 102 (see FIG. 2).

Figure 11:
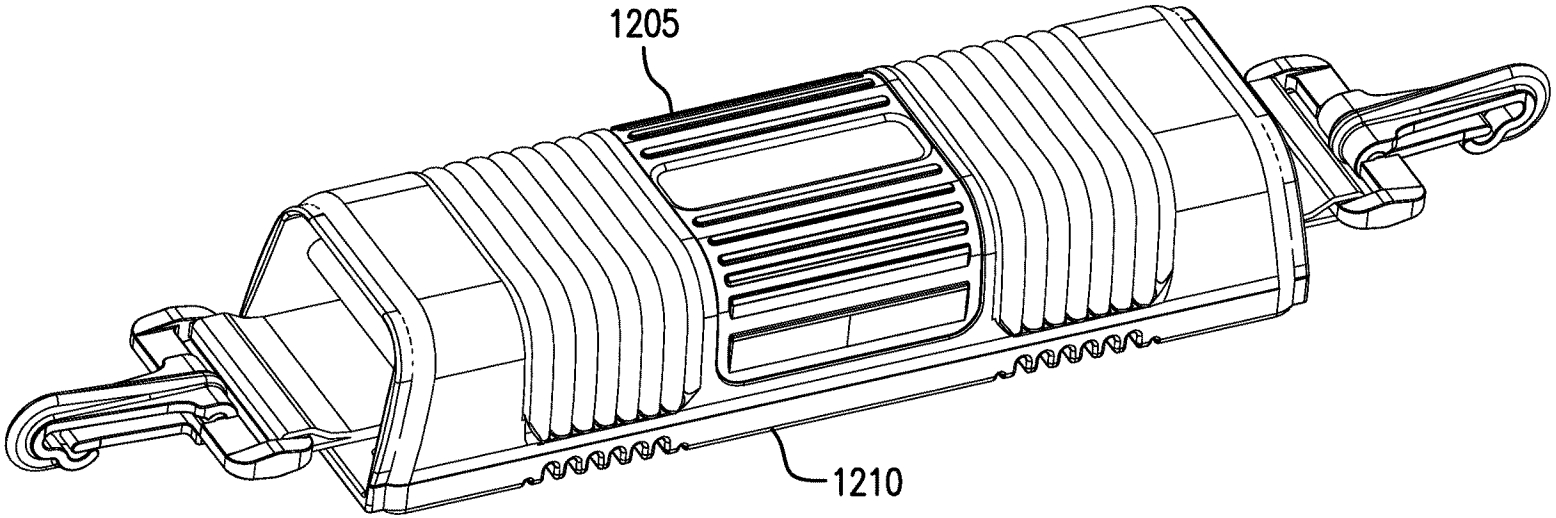
FIGS. 11 and 12 show, respectively, a top perspective view and a bottom perspective view of an embodiment of a retractable shoulder strap constructed according to an alternative exemplary embodiment of the present invention, wherein the cover and the base wall of the shoulder pad are constructed from a flexible polymer material, the cover and the base wall comprising ridges and ribs to support flexibility.
Figure 12:
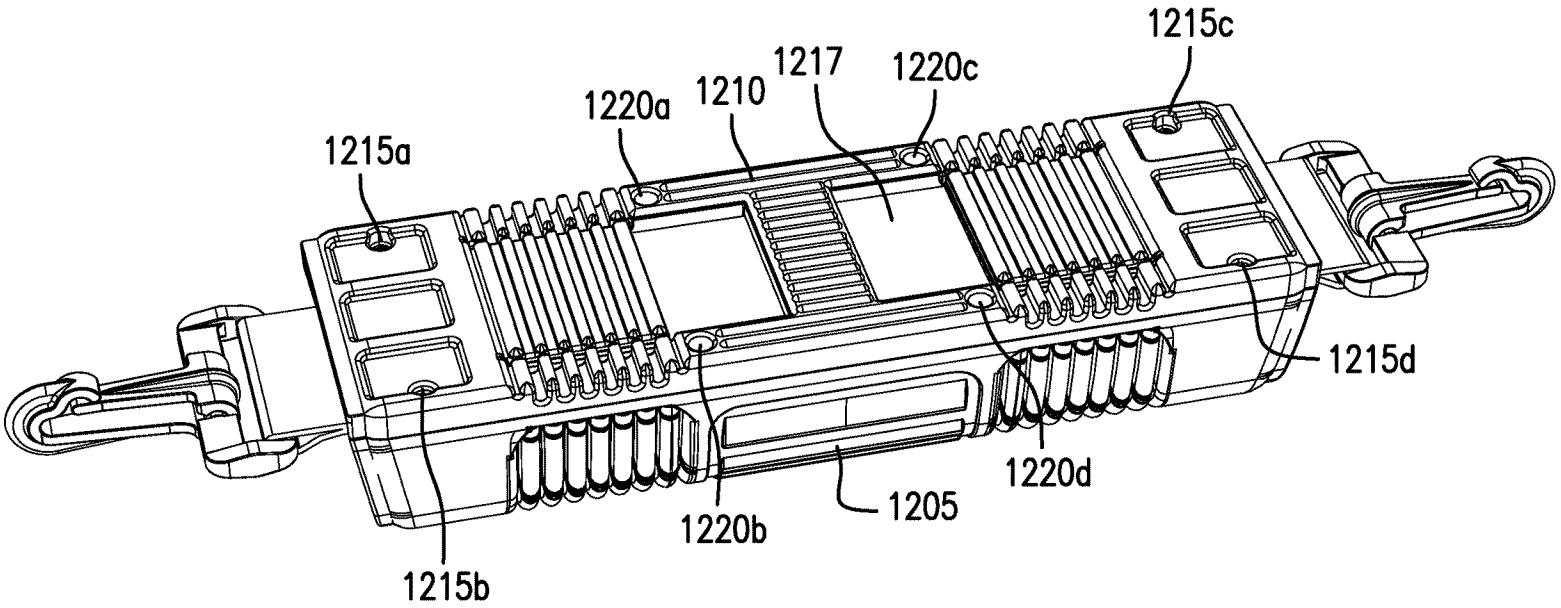

FIGS. 11 and 12 show, respectively, a top perspective view and a bottom perspective view of an embodiment of a retractable shoulder strap constructed according to an alternative exemplary embodiment of the present invention, wherein the cover and the base wall of the shoulder pad are constructed from a flexible polymer material, the cover and the base wall comprising ridges and ribs to support flexibility. As shown best in FIG. 12, the cover 1205 is attached to the base wall 1210 by a plurality of screws 1215*a*-1215*d*, as opposed to the stitching or adhesive that might be used when the base wall and cover are constructed from a cloth or fabric material. As also shown in FIG. 12, the middle section 1217 of the elongated strip of pliant material is fixedly attached to the base wall 1210 with a plurality of screws 1220*a*-1220*d*.

Figure 13:
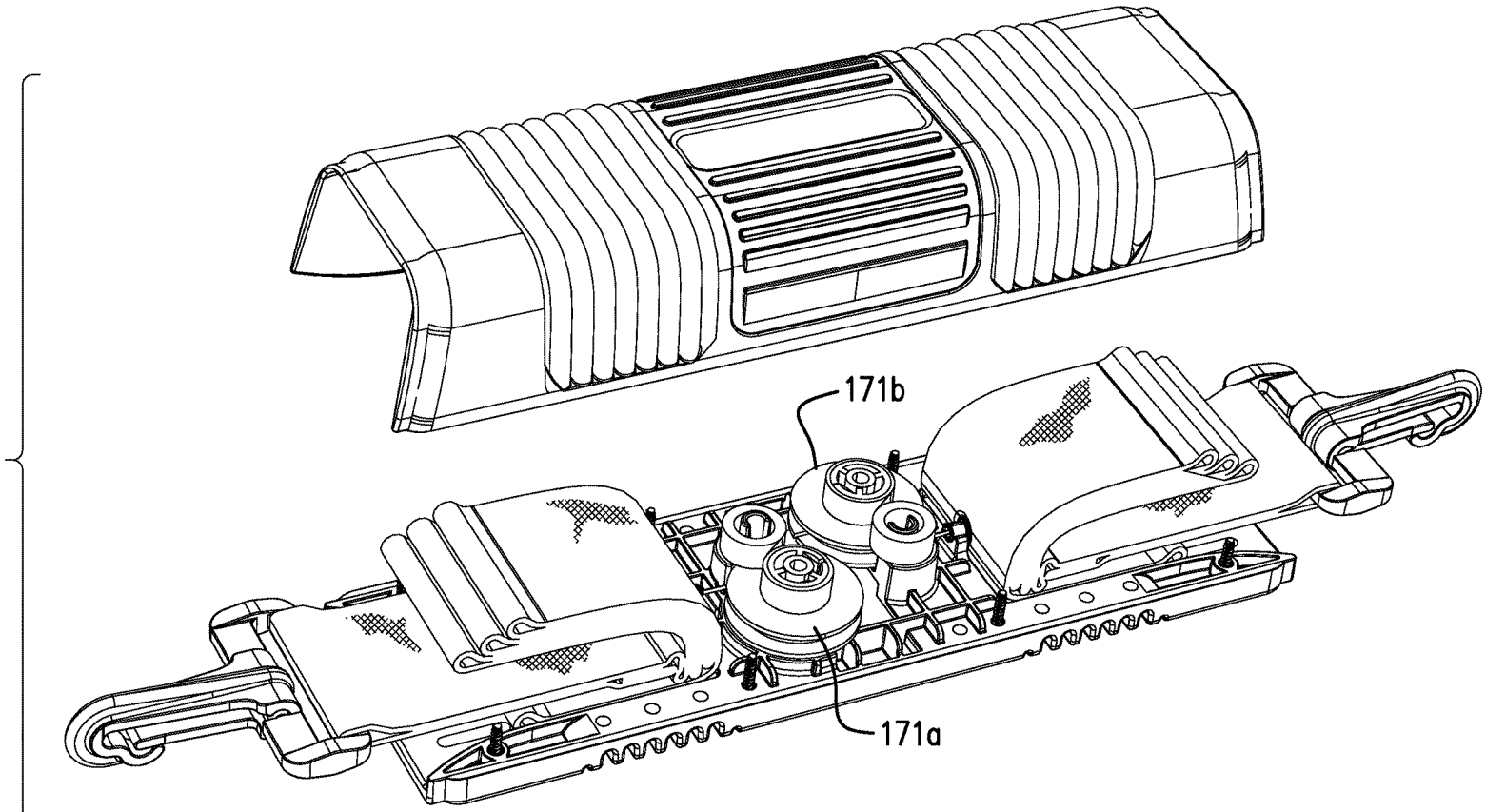
FIGS. 13 and 14 show, respectively, the embodiment of the retractable shoulder strap of FIGS. 11 and 12, with the cover of the shoulder pad removed to better illustrate the arrangement of the internal components of the shoulder pad.
Figure 14:
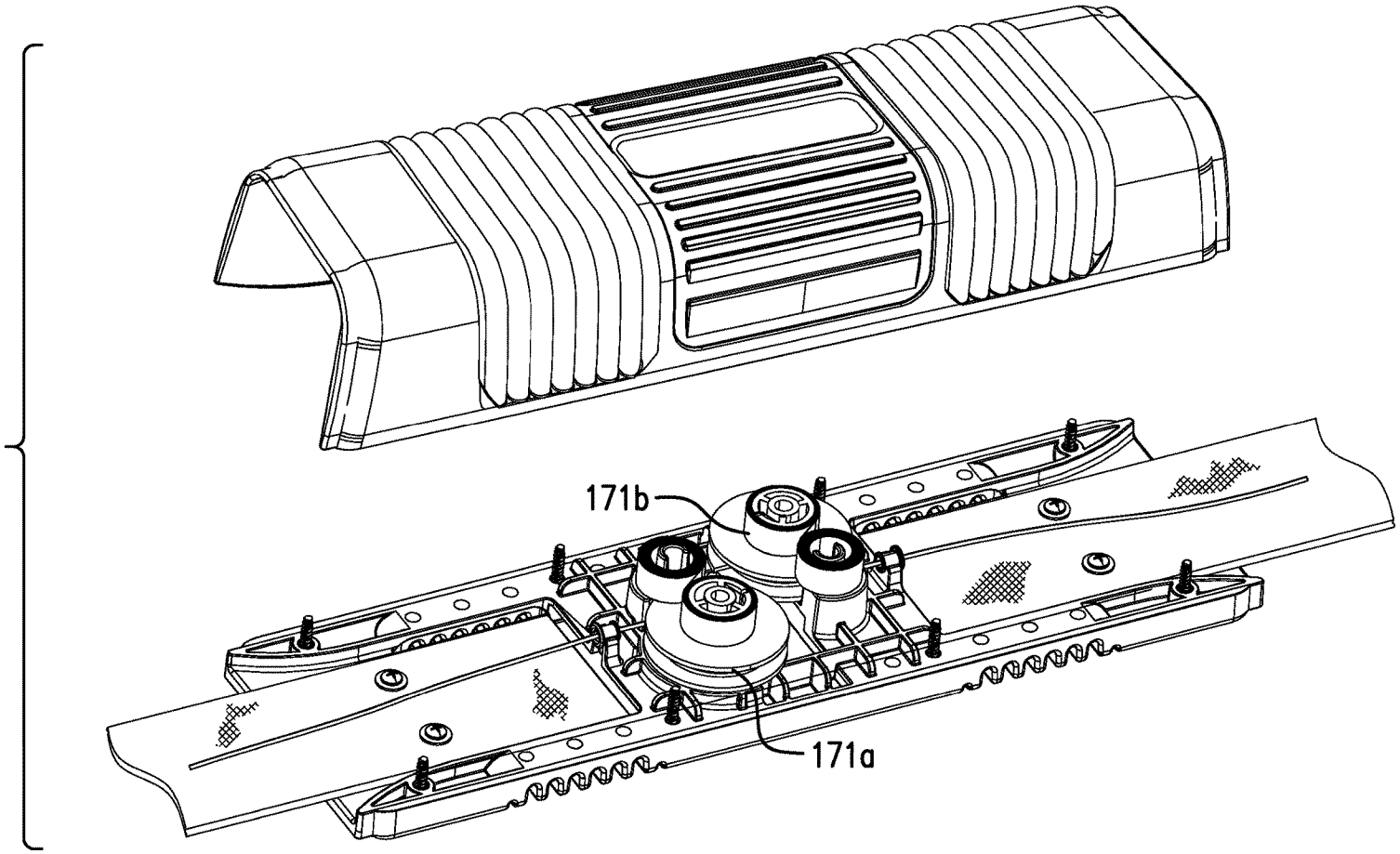

FIGS. 13 and 14 show, respectively, the embodiment of the retractable shoulder strap of FIGS. 11 and 12, with the cover of the shoulder pad removed to better illustrate the arrangement of the internal components of the shoulder pad. In FIG. 13, the forward and rearward sections of the elongated strip of pliant material in the strap are retracted and folded into the internal storage areas of the shoulder pad. In FIG. 14, the forward and rearward sections of the elongated strip of pliant material in the strap are extended and unfolded. Unlike the retractor 170 shown in FIG. 8, the pair of retractors 171*a* and 171*b* do not include retractor shells 172.

Figure 15:
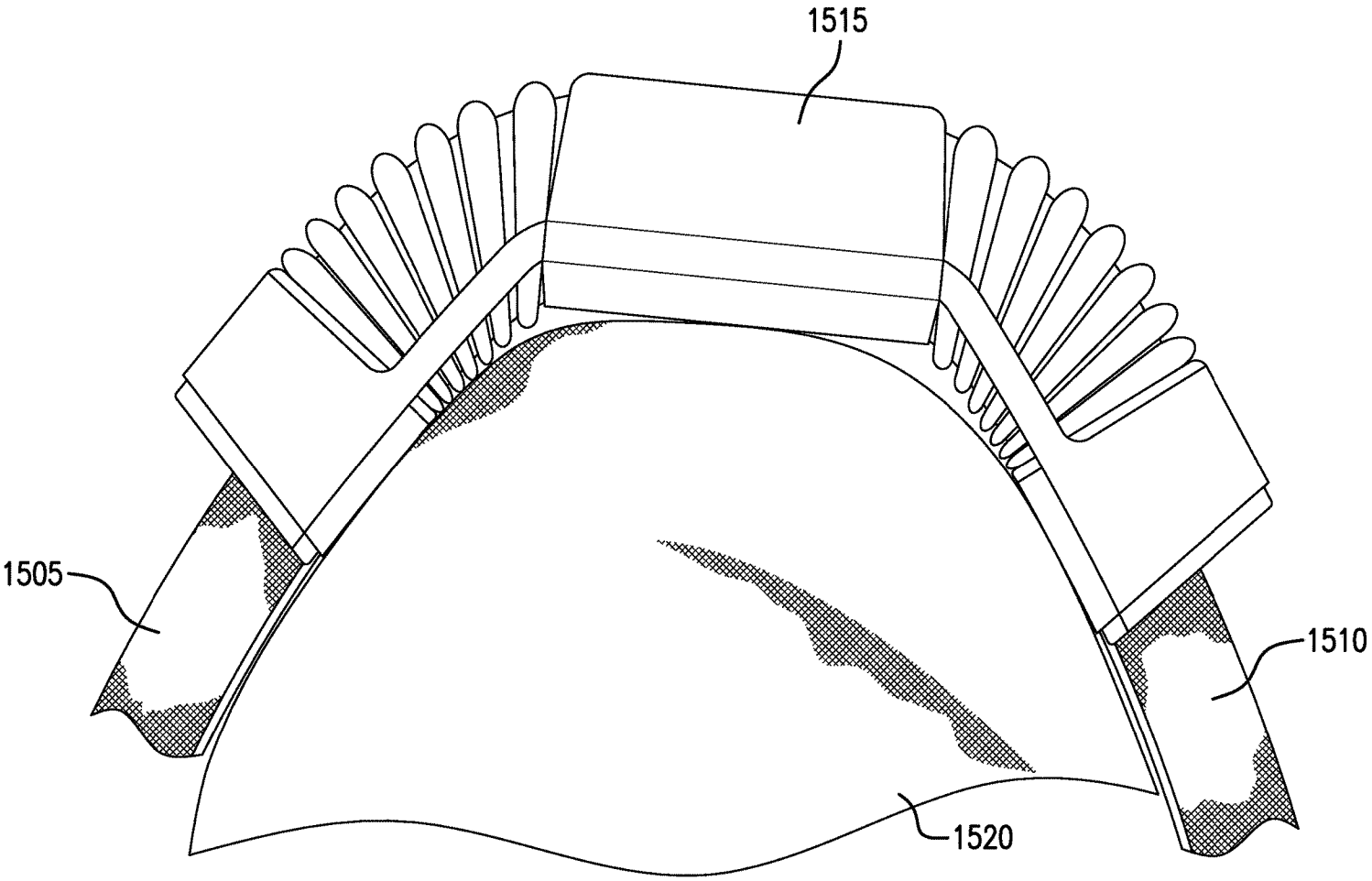
FIG. 15 shows the embodiment of the retractable should strap depicted in FIGS. 11 through 14, in a flexed position over the user's shoulder.

FIG. 15 shows a portion of the rearward section 1505 of the elongated strip of pliant material, a portion of the forward section 1510 of the elongated strip, and the shoulder pad 1515 of the embodiment of the retractable should strap depicted in FIGS. 11 through 14. As shown in FIG. 15, the shoulder pad 1515 is configured to flex and bend over the arc of the user's shoulder 1520 while the shoulder strap is in use and the rearward section 1505 and forward section 1510 of the elongated strip of pliant material are extended.

Although the exemplary embodiments, uses and advantages of the invention have been disclosed above with a certain degree of particularity, it will be apparent to those skilled in the art upon consideration of this specification and practice of the invention as disclosed herein that alterations and modifications can be made without departing from the spirit or the scope of the invention, which are intended to be limited only by the following claims and equivalents thereof.

What is claimed is:

1. A shoulder strap for a portable object, comprising:

a) a shoulder pad comprising a base wall and a cover joined together to define a pair of openings at opposite ends of the shoulder pad, a pair of internal storage spaces adjacent to the pair of openings, and a retractor housing area bounded by the base wall, the cover and the pair of internal storage spaces;

b) an elongated strip of pliant material passing through the pair of openings in the shoulder pad, the elongated strip comprising a forward section, a middle section and a rearward section, wherein the middle section is fixedly attached to the base wall, a portion of the forward section extends through one of the openings in the pair of openings so that the distal end of said forward section is located on the outside of one of the internal storage spaces, and a portion of the rearward section extends through the other opening in the pair of openings so that the distal end of said rearward section is located on the outside of the other internal storage space;

c) a plurality of holes positioned at intervals along the lengths of said forward and rearward sections of the elongated strip of pliant material; and d) a pair of retractors located inside the retractor housing area of the shoulder pad, the pair of retractors comprising a pair of rotatable spindles and a pair extendible guide wires configured to wind around the pair of rotatable spindles, respectively, wherein the distal ends of the pair of extendible guide wires are attached, respectively, to the distal ends of the forward and rearward sections of the elongated strip of pliant material so that the pair of extendible guide wires pass through the plurality of holes in the elongated strip of pliant material;

e) wherein the pair of rotatable spindles are biased so that, when no tension is applied to the distal ends of the forward and rearward sections of the elongated strip of pliant material, the pair of rotatable spindles will automatically rotate and wind the pair of extendible guide wires around the pair of rotatable spindles, thereby causing the forward and rearward sections of the elongated strip of pliant material to be retracted and stored inside the pair of internal storage spaces of the shoulder pad.

2. The shoulder strap of claim 1, wherein when a sufficient amount of tension is applied to the distal ends of the forward and rearward sections of the elongated strip of pliant material to overcome the bias on the pair of rotatable spindles, the pair of rotatable spindles will rotate and unwind the pair of extendible guide wires from the pair of rotatable spindles, respectively, thereby permitting the forward and rearward sections of the elongated strip of pliant material stored inside the pair of internal storage spaces, respectively, to be extracted from the pair internal storage spaces through the pair of openings in the shoulder pad.

3. The shoulder strap of claim 2, wherein attaching the portable object to the shoulder strap and permitting the shoulder strap to support the weight of the portable object provides the sufficient amount of tension to overcome the bias on the pair of rotatable spindles.

4. The shoulder strap of claim 1, wherein the pair of rotatable spindles are biased by a pair of springs.

5. The shoulder strap of claim 1, wherein:

a) the distal ends of the forward and rearward sections of the elongated strip of pliant material located on the outside of the pair of openings in the shoulder pad are configured to automatically bend and fold back upon themselves when the pair of extendible guide wires are wound around the pair of rotatable spindles; and b) the folded distal ends of the forward and rearward sections are retracted and stored inside the pair of internal storage spaces, respectively.

6. The shoulder strap of claim 5, wherein the folded distal ends of the forward and rearward sections of the elongated strip of pliant material stored inside the pair of internal storage spaces, respectively, are configured to automatically unfold when the tension to overcome the bias on the pair of rotatable spindles is applied to the folded distal ends of the forward and rearward sections.

7. The shoulder strap of claim 1, further comprising a pair of fasteners, connected to the distal ends of the forward section and the rearward section, respectively, such that the forward section and the rearward section of the elongated strip of pliant material may be releasably attached to the portable object.

8. The shoulder strap of claim 7, wherein the pair of fasteners comprises a pair of hooks, or a pair of clasps, or a pair of buckles, or a pair of snap fasteners, or a combination of two or more thereof.

9. The shoulder strap of claim 7, wherein the base wall of the shoulder pad abuts the portable object when the forward section and the rearward section of the elongated strip of pliant material are retracted and stored inside the pair of internal storage spaces of the shoulder pad.

10. The shoulder strap of claim 1, wherein the elongated strip of pliant material is constructed from fabric, or cloth, or leather, or nylon, or plastic, or vinyl, or rubber, or a combination of two or more thereof.

11. The shoulder strap of claim 1, wherein the pair of extendible guide wires are constructed from flexible lengths of nylon, or metal, or plastic, or fabric, or cloth, or leather, natural fiber cord, string, or a combination of two or more thereof.

12. The shoulder strap of claim 1, wherein the plurality of holes through which the pair of extendible guide wires pass are located substantially along the centers of the lengths of the forward section and rearward section of the elongated strip of pliant material.

13. The shoulder strap of claim 1, wherein the plurality of holes in the elongated strip through which the pair of extendible guide wires pass comprises a collection of corresponding pairs of holes, each corresponding pair of holes in the collection being located at substantially uniform intervals along the lengths of the forward section and the rearward section of the elongated strip of pliant material.

14. The shoulder strap of claim 1, wherein the base wall is constructed from fabric, or cloth, or leather, or nylon, or plastic, or vinyl, or rubber, or a combination of two or more thereof.

15. The shoulder strap of claim 1, wherein the cover is constructed from fabric, or cloth, or leather, or nylon, or plastic, or vinyl, or rubber, or a combination of two or more thereof.

16. The shoulder strap of claim 1, wherein, the forward section and the rearward section of the elongated strip of pliant material are hidden from view when the forward section and the rearward section are stored, respectively, inside the pair of internal storage spaces of the shoulder pad.

17. The shoulder strap of claim 1, further comprising a cushion sewn into the base wall of the shoulder pad.

18. The shoulder strap of claim 17, wherein the cushion is constructed from foam, or rubber, or silicone, or a combination of two or more thereof.

19. A personal carrying device, comprising:

a) a receptacle;

b) a shoulder pad comprising a base wall and a cover joined together to define a pair of openings at opposite ends of the shoulder pad, a pair of internal storage spaces adjacent to the pair of openings, and a retractor housing area bounded by the base wall, the cover and the pair of internal storage spaces;

c) an elongated strip of pliant material comprising a forward section, a middle section and a rearward section, wherein the middle section is fixedly attached to the base wall, a portion of the forward section is stored inside one of the internal storage spaces, and a portion of the rearward section is stored inside the other internal storage space;

d) a pair of retractors located inside the retractor housing area of the shoulder pad, the pair of retractors comprising a pair of rotatable spindles, the pair of rotatable spindles biased to automatically wind a pair of extendible guide wires around the pair of rotatable spindles, respectively, wherein the distal ends of the pair of extendible guide wires are attached, respectively, to the distal ends of the forward and rearward sections of the elongated strip of pliant material; and e) a pair of fasteners, attached to the distal ends of the forward section and the rearward section, respectively, configured to releasably fasten the distal ends of the forward section and the rearward section to the receptacle;

f) wherein, when the shoulder pad, the forward section and the rearward section are allowed to support the weight of the receptacle, the weight of the receptacle produces a sufficient amount of tension at the distal ends of the forward section and the rearward section of the elongated strip of pliant material to overcome the bias on the pair of rotatable spindles, thereby causing the pair of rotatable spindles to rotate and unwind the pair of extendible guide wires from around the pair of rotatable spindles, respectively;

g) whereby the portions of the forward section and the rearward section of the elongated strip of pliant material stored inside the pair of internal storage spaces, respectively, are automatically extracted from the pair internal storage spaces through the pair of openings in the shoulder pad.

20. The personal carrying device of claim 19, wherein, when the weight of the receptacle is removed from the shoulder pad, the forward section and the rearward section of the elongated strip of pliant material, the pair of rotatable spindles will automatically rotate and wind the pair of extendible guide wires around the pair of rotatable spindles, thereby causing the forward and rearward sections of the elongated strip of pliant material to be retracted and stored inside the pair of internal storage spaces of the shoulder pad.

21. The personal carrying device of claim 19, wherein the receptacle comprises a purse, or handbag, or briefcase, or satchel, or suitcase, or duffle bag, or carry-on, or computer bag, or athletic bag or equipment case.

* * * * *